United States Patent [19]

McGahee

[11] 3,959,789

[45] May 25, 1976

[54] CREDIT CARD MONITOR

[76] Inventor: Francis M. McGahee, 2437 Doctors Lake Drive, Orange Park, Fla. 32073

[22] Filed: Feb. 21, 1975

[21] Appl. No.: 551,929

[52] U.S. Cl. ..... 340/280; 340/282; 340/309.4; 340/371

[51] Int. Cl.[2] ..... G08B 7/00

[58] Field of Search ..... 340/280, 309.4, 282, 340/371, 149 A; 200/61.19

[56] References Cited

UNITED STATES PATENTS

| | | | |
|---|---|---|---|
| 1,546,509 | 7/1925 | Poole | 340/280 |
| 1,685,329 | 9/1928 | Lynch | 340/280 |
| 3,855,588 | 12/1974 | Buckland | 340/309.4 |

*Primary Examiner*—Harold Pitts
*Attorney, Agent, or Firm*—Harold A. Gell, Jr.

[57] ABSTRACT

A check or credit card monitor consisting of a plurality of normally closed switches adapted to be held open by insertion of credit cards or similar items between the switch contacts. The contacts are connected in parallel to a timing means adapted to energize a sensory alarm such as an audio signal, vibrator or light a predetermined time after closure of any one of said plurality of switches.

13 Claims, 7 Drawing Figures

FIG. 3
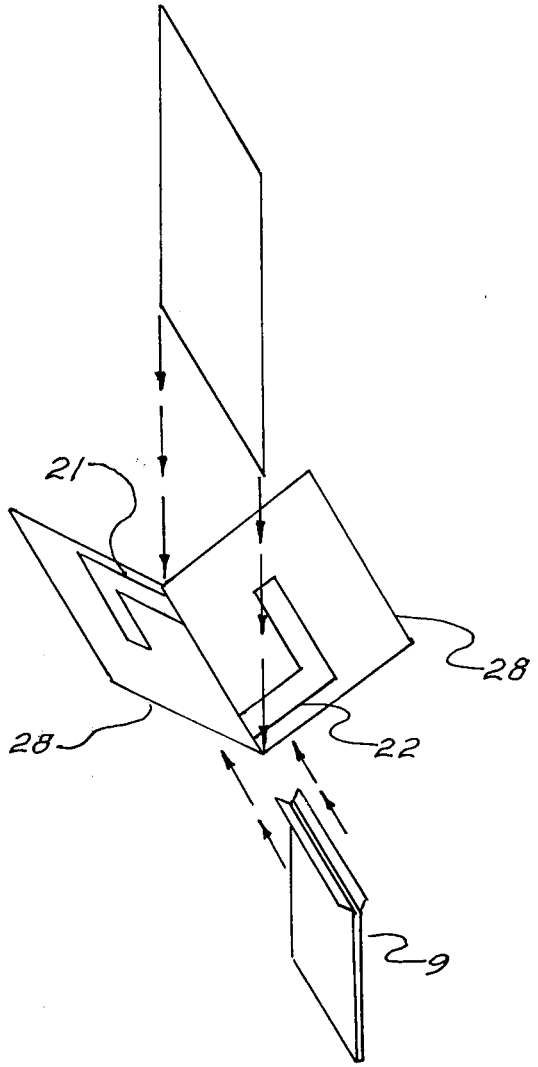
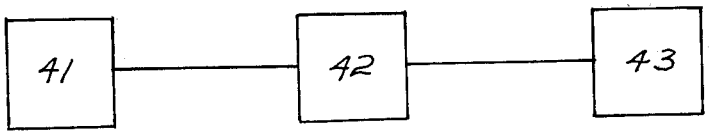
FIG. 4

CREDIT CARD MONITOR

THE INVENTION

This invention relates to a system for alerting an individual to the fact that a credit card or similar item has been removed from a carrying case a predetermined length of time.

BACKGROUND OF THE INVENTION

In todays complex society individuals carry numerous important documents such as credit cards, drivers licenses, key cards and other identification means on their person in card carrying cases or wallets. These items are removed from their cases repeatedly and in most instances termporarily given to other persons when the owner is making a purchase, cashing a check or engaged in a variety of different functions. Due to the relatively inconspicuous nature of the documents, they can be forgotten and left on a counter, with another person, or in a lock. Furthermore, credit cards are extremely valuable property much sought after in the criminal world and thus subject to being stolen when left unattended. Although inconspicuous, they are immensely important to the owner and difficult to replace. Therefore, it is desirable to have a means to alert a person when he has removed a document from its carrying case and not returned it after a predetermine period of time.

Attempts have been made to solve the foregoing and similar problems but they failed to meet all of the needs. For instance, U.S. Pat. No. 3,648,832 discloses a card carrying case which remains in an open condition when a card is removed. This renders a case difficult to return to a tight pocket without the card but does nothing to prevent its placement in a purse or loose pocket or to prevent it from being left on a counter.

U.S. Pat. No. 3,701,987 discloses a system which provides an indication when a card is not returned to its proper place in a file. This system requires that each card or document have a conductive strip thereon. Since placement of a conductive strip on all the documents one would carry is impractical and in some cases impossible, this system can not be readily adapted to a card carrying case. Furthermore, it would present an alarm concition as long as a document is removed and thus it would be an annoyance while a transaction is taking place and possibly a user would become accustomed to the alarm and thus defeat any monitoring functions it might serve.

OBJECTS OF THE INVENTION

Therefore, it is an object of the present invention to provide a document monitoring means which will alert an individual when a document has been removed and not returned after a predetermined length of time.

It is a further objective of this invention to provide a means to alert an individual when he has left his card carrying case on a counter or table a predetermined period of time.

It is a still further object of this invention to provide a card monitoring means that may be incorporated into a wallet.

Another object of the invention is to provide a card monitor which will alert a user having a sensory handicap such as blindness or deafness.

Another object of the invention is to provide a card monitoring system which is rugged, relatively fail safe and inexpensive to manufacture.

The foregoing and other objectives of the invention will become apparent in light of the drawings, specifications and claims contained herein.

SUMMARY OF THE INVENTION

This invention is directed to a check or credit card monitor which consists of a plurality of switches which are formed from conductive means affixed to the surface of separators in a card carrying case. The separators are biased together and the electrical contacts affixed thereto are interconnected to form a plurality of normally closed, electrically parallel switches. The switches are interconnected to provide electrical current to a time delay means which is adapted to energize a sensory warning a predetermined time after closure of one of the switches. In normal operation, credit cards or other documents are inserted between all of the separators so that removal of any document will result in the closure of one switch and the activation of the system.

In an alternate embodiment of the instant invention, a mercury switch is connected in parallel with the card sensing switches and oriented in the case so that it will present a closed circuit if the case is layed on its side in the normal manner. In this embodiment the switch will be open while the case is carried on ones person or deposited in a purse or in a proper orientation on a night stand but closed when deposited on a counter or table top in its most stable orientation.

DESCRIPTION OF THE DRAWINGS

In the drawings, which illustrate the primary embodiments of the instant invention:

FIG. 3 is a plan view of two separators illustrating a suggested contact orientation.

FIG. 4 is a block diagram representing the electronic functions of the instant invention.

DESCRIPTION OF THE INVENTION

Figure 1:
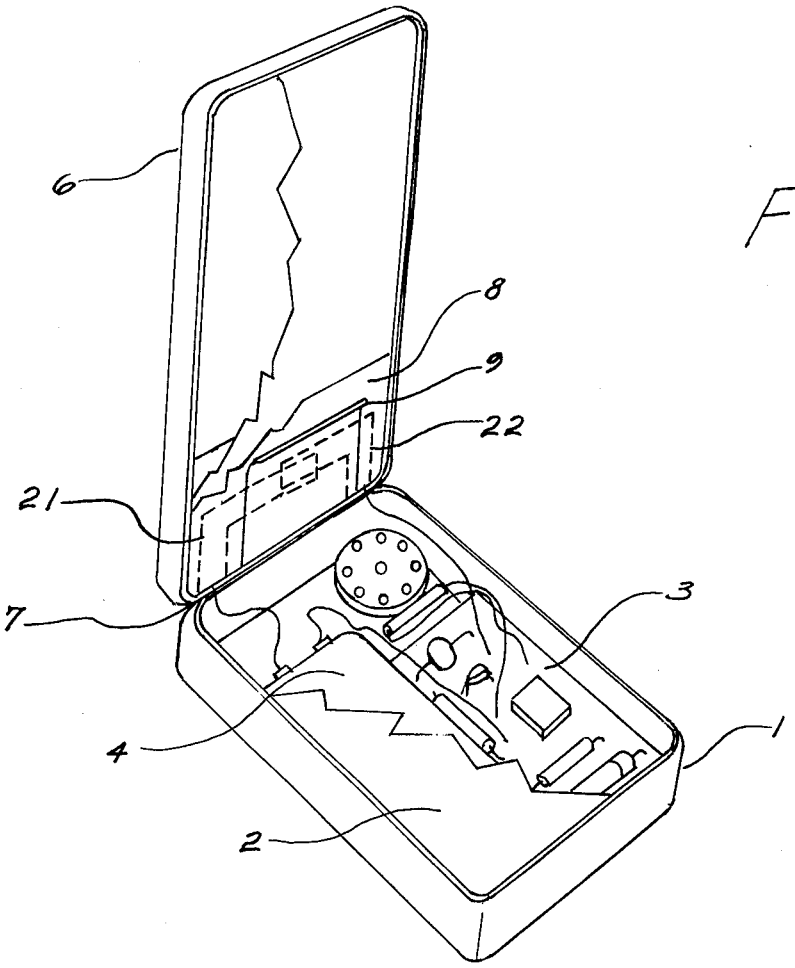
FIG. 1 is a perspective view of a card carrying case embodying the invention.

Referring to the drawings, FIG. 1 illustrates a preferred embodiment of the instant invention which includes a case having a bottom portion 1 which is in the form of a shallow rectangular box open on the top and provided with a removable cover 2. The electrical components of the monitoring system are contained in this portion of the case. These components are, a printed circuit board including electronic components 3, a battery 4, and an alarm means 5. The alarm means 5 may be a speaker to generate an audio signal, a lamp to generate a visual signal, or a buzzer to generate a mechanically sensed signal.

A cover 6 is affixed to the case 2 by a hinge 7. This cover incorporates a plurality of document retaining pockets 8 which incorporate electrical contact means to form a plurality of switches electrically connected between the battery 4 and printed circuit board 3. A bias means 9 is affixed to the case cover 6 and adapted to secure the document pockets 8 thereto and insure that the electrical contact surfaces of the various dividers of the document pockets will be in physical contact, forming a closed electric circuit, when an individual document pocket is empty.

In an alternate embodiment of this invention, a mercury switch may be included in the bottom portion of the case 3 to serve as a means to alert a user when the case is layed in a predetermined position.

Figure 2:
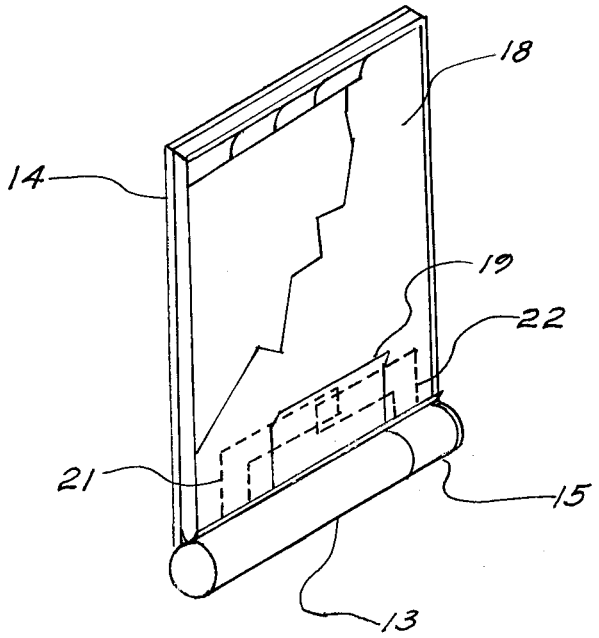
FIG. 2 is a perspective view of an alternate embodiment of the instant invention utilizing a flexible battery.

FIG. 2 illustrates another alternate embodiment of this invention. In this embodiment a printed circuit 13 is formed in a narrow, oblong shape and adapted so that when combined with a signal means 15 the two form a base for a plurality of document pockets 18 which are secured thereto by spring means 19. A flat flexible battery 14 provides the power for a third embodiment of the invention. It is attached to the back of the assembly and may be utilized as a securing means to form a removable card case that may be inserted into a wallet.

FIG. 3 illustrates the separators 28 which form the document pockets 8 and 18 of FIGS. 1 and 2. The internal separators have electrical conducting means 21 and 22 incorporated in either side and positioned so that when two separators are pressed together, contact 21 of one separator forms an electrical connection with contact 22 of the adjacent separator. In operation, documents are inserted in the pockets and form an insulation between contacts 21 and 22 and thus hold the circuit open until removed. When removed, the spring bias means indicated as 9 and 19 in FIGS. 1 and 2 insure that a good mechanical bond is made between contacts 21 and 22 to complete an electrical circuit.

The basic electronic configuration of the invention is illustrated in FIG. 4 wherein block 41 represents the various normally closed switches formed by the document pocket separators, 42 represents a time delay means adapted to be responsive to the closure of one of the switches in block 41 and provide an electrical output a predetermined time after closure thereof. The electrical output is applied to alarm means 43 to provide a sensory signal that a card has been removed from a document pocket.

Figure 5:
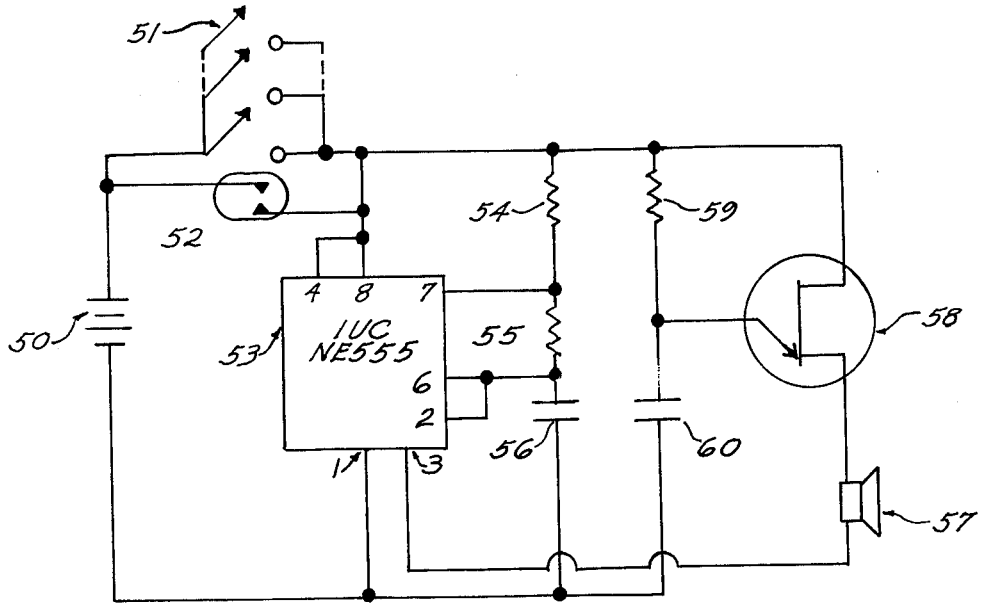
FIG. 5 is a schematic representation of a preferred embodiment of the instant invention incorporating an audio alarm.

A preferred embodiment of the invention is schematically illustrated in FIG. 5 wherein the switches formed by contact means 21 and 22 of separators 28 are illustrated as a plurality of switching devices 51 in parallel with a mercury switch 52. These switches provide a positive potential from battery 50 to the integrated circuit 53 and the alarm means.

The integrated circuit 53 is a standard NE555 integrated circuit which includes two comparators responsive to predetermined voltage levels connected to pins 5 and 7. These comparators are connected to a resistance voltage divider network comprised of resistors 54 and 55 which form a series network that charges capacitor 56 when one of the switches 51 or 52 are closed and creates a time delay operation of integrated circuit 53. In the quiescent state of integrated circuit 53, pin 3 is open. When a switch 51 or 52 closes, capacitor 56 begins to charge through resistors 54 and 55. When it reaches a predetermined charge level, the comparator of integrated circuit 53 connected to pin 6 sets a flip flop within the integrated circuit which allows the capacitor to be discharged to the voltage level sensed at pin 7 of the integrated circuit. When that voltage level is reached at pins 2 and 6 of integrated circuit 53, the flip flop is reset and the partially discharged capacitor 56 is allowed to charge up to its full charge state. When the integrated circuit 53 flip flop is in a set condition causing the discharge of capacitor 56, pin 3 of the integrated circuit is connected to ground. This enables an oscillator comprised of speaker 57, unijunction transistor 58, resistor 59 and capacitor 60.

If a carbon microphone or other low impedance microphone or speaker is utilized, the circuit will function satisfactorily essentially as illustrated in FIG. 5. However, if a crystal microphone or other high impedance device is used, a parallel resistance must be inserted in the circuit to decrease the impedance, unless a transistor is selected for the oscillator which is capable of functioning at a high impedance level.

Figure 6:
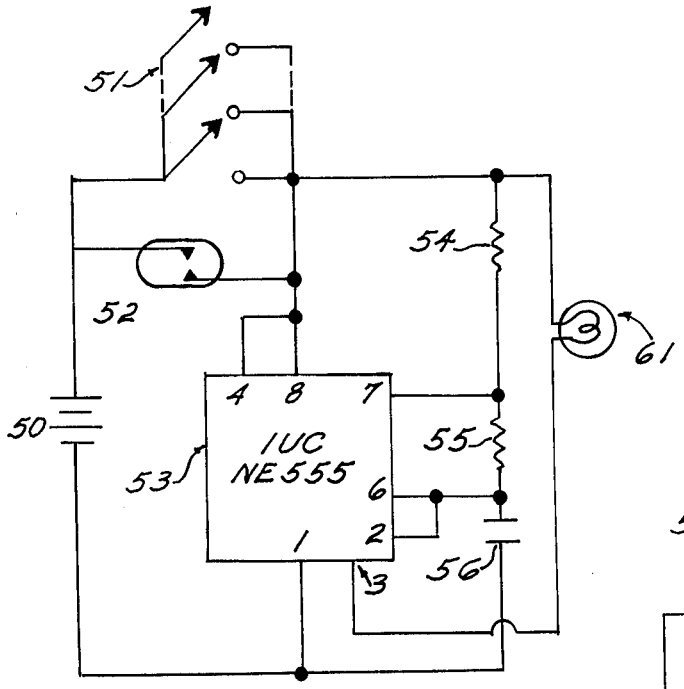
FIG. 6 is a schematic view of a preferred embodiment of the invention incorporating a visual alarm.

FIG. 6 is an alternate embodiment of the invention which utilizes a lamp to create an optical signal. In this embodiment the oscillator and microphone of FIG. 5 is removed and replaced by a light 61. In this embodiment, when the flip flop of integrated circuit 53 is set and capacitor 56 discharging, the lamp is illuminated.

Figure 7:
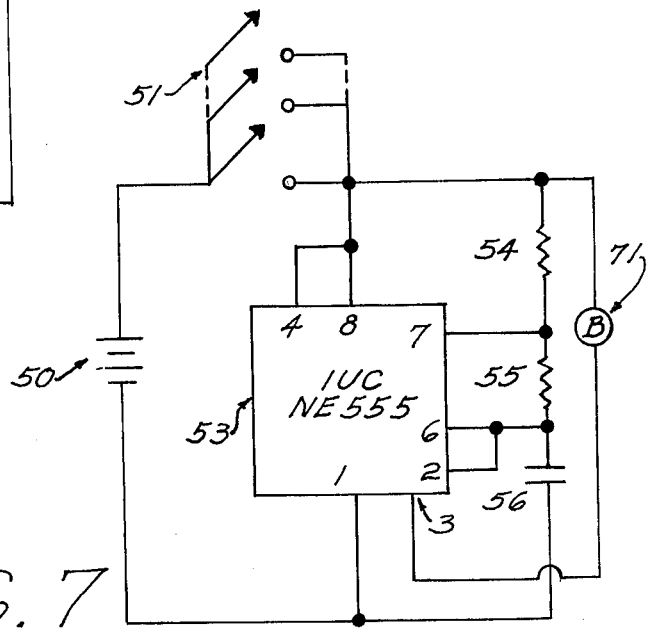
FIG. 7 is a preferred embodiment of the invention incorporating a buzzer.

FIG. 7 is another alternate embodiment of the instant invention which utilizes integrated circuit 53 as a timing means. This circuit is distinguishable from the circuits illustrated in FIGS. 5 and 6 in that the oscillator and microphone on FIG. 5 or the lamp of FIG. 6 is removed and replaced by a vibrating element 71 which may be adapted to provide a sensory warning. In most applications of this embodiment, a mercury switch is not required since it is anticipated that the device would be carried on ones person to enable the vibrator to provide an adequate warning means.

While preferred embodiments of this invention have been illustrated and described, variations and modifications may be apparent to those skilled in the art. Therefore, I do not wish to be limited thereto and ask that the scope and breadth of this invention be determined from the claims which follow rather than the above description.

What I claim is:

1. A document holder, comprising:

a plurality of separators adapted to hold documents there between, said separators constructed from electrically nonconductive material and incorporating electrically conductive members on facing surfaces positioned to form normally closed electrical contact pairs, said contact pairs adapted to be held open by documents inserted there between;

a switching means comprised of said contact pairs connected in electrical parallel;

a power source electrically connected to said switching means;

a time delay means responsive to said switching means; and an alarm means responsive to said time delay means.

2. A document holder as defined in claim 1, comprising:

a mercury switch electrically connected in parallel to said switching means.

3. A document holder as defined in claim 1 wherein said alarm means comprises:

a lamp.

4. A document holder as defined in claim 1 wherein said alarm means comprises:

a buzzer.

5. A document holder as defined in claim 1 wherein said alarm means comprises:

a source of audio signals;

and a speaker.

6. A document holder as defined in claim 5 wherein said source of audio signals comprises:

an oscillator.

7. A document holder as defined in claim 1 wherein said power source comprises:

a battery.

8. A document holder as defined in claim 1 wherein said power source comprises:

a flat flexible battery.

9. A document holder as defined in claim 1 wherein said time delay means comprises:

a two state electronic switch responsive to first and second voltage levels;

a capacitor;

and a voltage divider network for charging said capacitor to said first voltage level and discharging said capacitor to said second voltage level in response to the respective opposite voltage level states of said electronic switch.

10. A document holder as defined in claim 9 wherein said two state electronic switch comprises:

a first voltage level comparator;

and a second voltage level comparator.

11. A document holder as defined in claim 1, comprising:

a case including a bottom section adapted to retain said power source, said time delay means, and said alarm means;

a top section flexibly affixed to said bottom section adapted to hold said plurality of separators and receive documents;

and a spring bias means to secure said plurality of separators in said top section and insure positive contact of said electrically conductive members.

12. A document holder as defined in claim 7, comprising:

a case adapted to house said time delay means and said alarm means;

a spring bias means affixed to said case and adapted to hold said plurality of separators and insure positive contact of said electrically conductive members; and means to affix said flat flexible battery to said case.

13. A credit card carrying case, including a credit card monitor comprising:

means for holding at least one credit card;

a time delay means;

means responsive to the removal of any one of said credit cards and adapted to initiate said time delay means; and an alarm means responsive to said time delay means timing out for providing a credit card missing alert.

* * * * *